United States Patent [19]

Victorovich et al.

[11] Patent Number: 4,802,917

[45] Date of Patent: Feb. 7, 1989

[54] COPPER SMELTING WITH CALCAREOUS FLUX

[75] Inventors: Grigori S. Victorovich, Toronto; Carlos M. Diaz; Charles E. O'Neill, both of Mississauga, all of Canada

[73] Assignee: Inco Limited, Toronto, Canada

[21] Appl. No.: 827,085

[22] Filed: Feb. 7, 1986

[30] Foreign Application Priority Data

Mar. 20, 1985 [CA] Canada ..... 476987

[51] Int. Cl.[4] ..... C22B 15/00

[52] U.S. Cl. ..... 75/26; 75/74

[58] Field of Search ..... 75/26, 74

[56] References Cited

U.S. PATENT DOCUMENTS 3,674,463 7/1972 Yannopoulos ..... 75/72

4,030,915 2/1977 Aaltonen et al. ..... 75/74

4,388,110 6/1983 Jensfelt et al. ..... 75/74

4,415,356 11/1983 Victorovich et al. ..... 75/21

4,416,690 11/1983 Richards et al. ..... 75/26

FOREIGN PATENT DOCUMENTS 2117410 10/1983 United Kingdom .

*Primary Examiner*—Melvyn J. Andrews

*Attorney, Agent, or Firm*—Raymond J. Kenny; Francis J. Mulligan, Jr.

[57] ABSTRACT

A process for autogenously smelting copper sulfide ore concentrate directly to semi-blister copper in which a calcareous flux is charged directly to an autogenouse furnace along with concentrate and copper-containing coolant. Furnace products are semi-blister copper, calcareous slag and off-gas rich in sulfur dioxide.

5 Claims, 1 Drawing Sheet

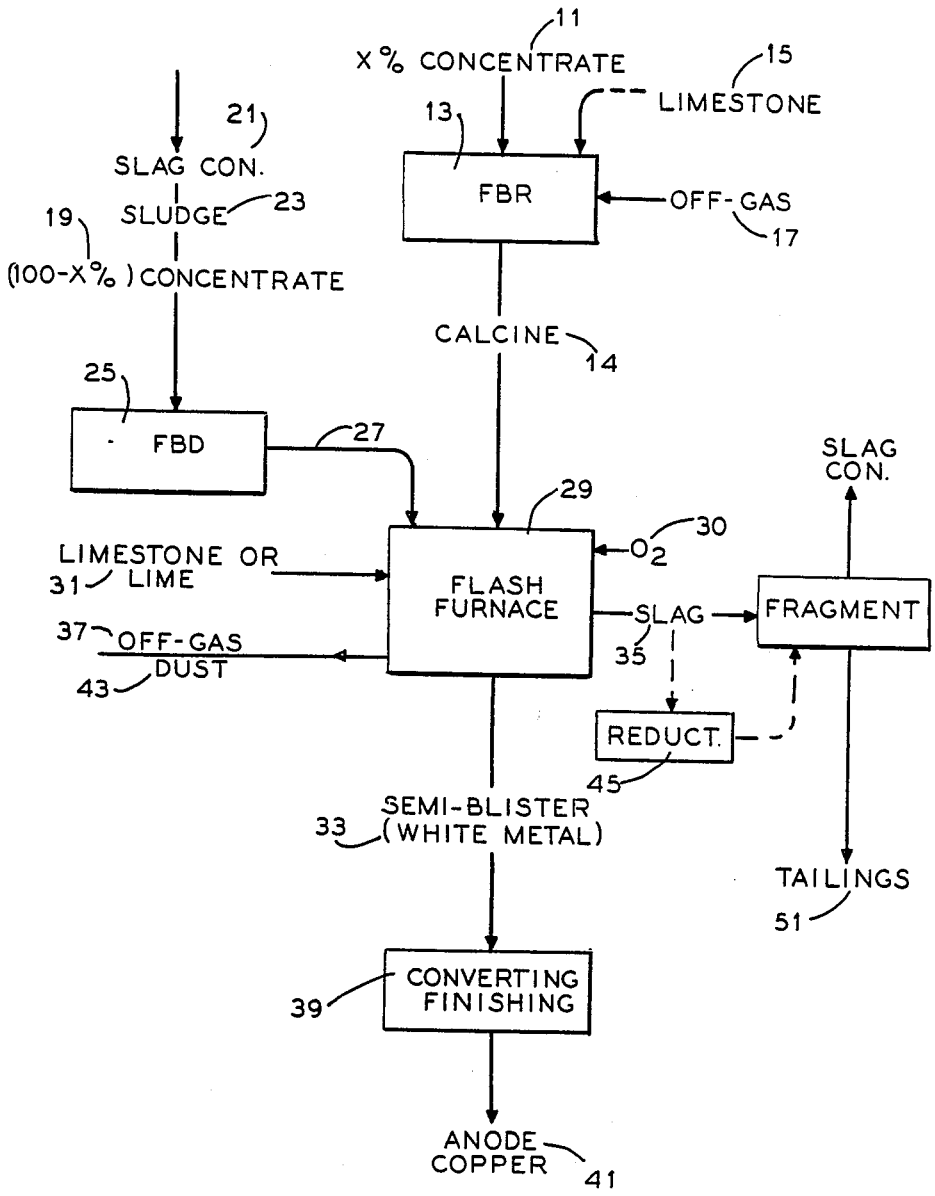
11
X % CONCENTRATE
15
LIMESTONE
13
FBR
OFF-GAS
17
21
SLAG CON.
SLUDGE
23
19
(100-X%) CONCENTRATE
CALCINE
14
25
FBD
27
29
30
$O_2$
SLAG CON.
LIMESTONE OR LIME
31
FLASH FURNACE
SLAG
35
FRAGMENT
37
OFF-GAS DUST
43
REDUCT.
45
SEMI-BLISTER (WHITE METAL)
33
TAILINGS
51
CONVERTING FINISHING
39
ANODE COPPER
41

COPPER SMELTING WITH CALCAREOUS FLUX

BACKGROUND OF THE INVENTION AND THE PRIOR ART

In U.S. Pat. No. 4,415,356 (the '356 patent) there is disclosed a process for autogenous oxygen smelting of sulfide materials containing base metals. The extensive prior art relating to autogenous smelting of copper and nickel sulfide materials is discussed in the '356 patent and the invention described therein is disclosed as:

> "The invention is based on the discovery that in the oxidation smelting the matte grade generated in the smelting furnace can be controlled by dividing the metal sulfide material stream to be smelted such that a portion of the stream is subjected to at least partial or even dead roasting, is then mixed with additional fresh metal sulfide material before being fed to the flash smelting furnace along with flux in the usual manner. This technique permits an upgrading in the matte grade produced, and is particularly applicable to oxygen flash smelting."

The '356 patent goes further to state:

> "It will be appreciated that the roasting step which forms part of the invention may be accomplished in equipment such as a fluid bed roaster. When this is done, a gas containing at least 10% of sulfur dioxide is produced which may be employed as feed for a sulfuric acid plant. In this way sulfur removed from the portion of concentrate which is roasted can be recovered and is not discharged to the atmosphere. Roasting in the fluid bed can be accomplished using air as the oxidant.
>
> The blend of roasted and dry unroasted concentrate, mixed with silicious flux, is injected into the smelting furnace in a stream of oxygen. The desired composition of matte to be obtained can be controlled by adjusting the ratio of calcine to green sulfide material in the feed. For a given concentrate, heat balance calculations will dictate the relative proportions of calcine and green sulfide material which have to be fed to yield the desired produce on autogenous smelting."

Thus, the '356 patent discloses a process in which sulfur dioxide is a product of the roasting step and that silicious flux is mixed with the blend of roasted and unroasted concentrate and injected into the smelting furnace. The '356 patent also considers possible variations in the disclosed process in the following language:

> "It is preferred to dead roast only a proportion of concentrate fed to the smelter since in this way materials handling is minimized. Similarly, other sulfide materials equivalent in general metallurgical characteristics to sulfide concentrates, e.g., furnace mattes, can be treated in accordance with precepts of the invention. As noted hereinbefore, for a given sulfide material and a given furnace a sufficient amount of oxygen per unit weight of sulfides must be provided to supply the heat balance of the operation. Thus, for a given sulfide material, heat balance calculations will establish the relative proportions of calcined and uncalcined material to be employed, matte grade, or whether the given sulfide material is treatable by oxidation smelting. It will be apparent from the foregoing description that oxidation smelting, e.g., autogenous oxygen flash smelting, can be carried out in two stages. Thus copper concentrate can be flash smelted in a first operation to matte grade of about 55% while producing a slag which can be discarded; the matte can be granulated, ground and smelted in a second flash melter to yield white metal or blister copper with the slag from the second flash smelter being returned to the first smelter operation. Alternatively, the slag from the secod operation can be slow cooled, concentrated and the concentrate returned. Calcine can be fed to either or both of the flash smelting operations along with the sulfide feed in accordance with heat balance requirements and to control product grade therefrom."

In gaining experience with the process of the '356 patent, applicant has found that the silica-based slags used in the patented process require a difficult slag cleaning operation in an electric furnace or slow cooling and flotation of copper metal to achieve good copper recovery. In addition, when blister copper is produced from iron-containing materials, the silica-based slags are viscous and contain high magnetite concentrations.

In U.K. published specification No. 2117410A of Oct. 12, 1983; it is disclosed that copper mattes may be autogenously combusted with oxygen in a flash furnace in the presence of a lime-ferrite slag. The principal source of lime-ferrite slag in the process of U.K. published specification No. 2117410A is a recycled, non-magnetic fraction of flash furnace slag which has been treated by slow cooling, grinding and magnetic separation. The non-magnetic fraction of the slag which is disclosed as a recyclable feed, along with freshly ground matte for the flash furnace (together with make-up calcareous flux) contains the bulk of the copper and calcium in the slag.

U.S. Pat. No. 4,416,690 (the '690 patent) discloses the use of lime flux in the flash smelting of copper matte and the possible use of a wide variety of coolants in this process. In the two examples given in this patent, no coolant is employed and there is no specific disclosure of any treatment of slag produced in the process.

OBJECT OF THE INVENTION

It is an object of the invention to provide a process for autogenous smelting of sulfide materials which is improved compared to the processes of the '356 and '670 patent U.K. published specification No. 2117410A.

DRAWING

The FIGURE is flow chart of an advantageous embodiment of the process of the present invention.

GENERAL DESCRIPTION OF THE INVENTION

The present invention contemplates a process of converting copper sulfide ore concentrate to a copper metal product at least as rich in copper as semi-blister copper which contains a small amount of $Cu_2S$ white metal phase and substantially no iron. This process comprises charging a calcareous flux and a sulfidic copper ore concentrate having, when iron is present, a high ratio of Fe to $SiO_2$ into a bounded space space and autogenously combusting said ore concentrate therein with an oxygen-containing gas in the presence of a coolant to thereby provide a lime-base slag containing essentially all the iron and silica present in said sufidic copper material and other materials charged to the bounded space, a molten copper metal containing up to about 1.5% sulfur and an off-gas containing sulfur dioxide.

Copper values in the slag produced in the autogenous combustion process can be recovered from the lime-base slag in any convenient manner. It is preferred to employ slag cleaning to produce metallic copper. Advantageously and preferably, the copper values recovered from the slag are recycled into the bounded space along with flux and non-sulfidic copper material as at least part of the coolant required to maintain temperature control in the process.

Copper ore concentrates treated in accordance with the present invention include chalcopyrite ($CuFeS_2$) concentrate, bornite ($Cu_5FeS_4$) concentrate, chalcocite ($Cu_2S$) concentrate and other concentrates containing mixed copper mineral species. Concentrates generally include significant amounts of silica derived from rock components in the concentrate. When iron is present in the copper ore concentrate to be treated, or in any coolant or other material introduced into the autogenous combustion reaction, the weight ratio of iron to silica should be high.

In the present description, autogenous combustion in a bounded space is specifically disclosed as flash smelting in an INCO-type flash smelting furnace such as described in Canadian Pat. No. 503,444 (corresponding to U.S. Pat. No. 2,668,107). However, the present invention is applicable to any type of furnacing where the sulfur and iron, if any, content of the feed constitutes the principal source of the fuel to maintain furnace temperature and provide the heat necessary for carrying out the reaction. Examples of suitable furnaces include vortex furnaces, shaft furnaces etc. The only basic criteria of suitable furnaces are that they confine the reactants and liquid products and that they enable gaseous products containing sulfur dioxide to be treated prior to atmospheric discharge.

Calcareous fluxes especially useful in the process of the present invention are lime, slaked lime and limestone. It is important that these fluxes be low in magnesia in order to avoid much as possible high melting phases in the process slag. Also, if iron is a component of any feed material to the process, contents of silica in the feed materials entering the present process are important in that (A) there is a limited area in the $FeO$-$Fe_2O_3$-$CaO$ ternary diagram which represents lime ferrite slags molten at temperatures below about 1300° C. and that (B) reaction of lime with silica excludes such reacted limes from contributing to the $FeO$-$CaO$-$Fe_2O_3$ system. As discussed hereinafter, it is advantageous that the lime-base slag produced in the process of the invention have a ferric to ferrous ratio no greater than about 2.5 in order to be self-reducing with respect to copper oxide while the slag is in the liquid state. This $Fe^{3+}/Fe^{2+}$ ratio permits rapid slag cooling and adequate metallic copper formation by self reduction provided that the slag liquidus temperature is low enough to permit reduction to take place in the liquid phase. This self reduction is especially effective if the $Fe_2O_3$-$FeO$-$CaO$ portion of the slag approximates in weight percent 21% CaO, 47% $Fe_2O_3$ and 32% FeO and 32% FeO and contains on cooling, the phase $CaO$-$FeO$-$Fe_3O$ (CM). If too much lime withdrawn from this portion of the slag, for example as $2CaO$-$SiO_2$ the melting point in the $Fe_3O_3$-$FeO$-$CaO$ system will exceed 1300° and, if at the same time, the $Fe^{3+}$ to $Fe^{2+}$ ratio increases, the phase $4CaO$-$FeO$-$4Fe_2O_3$ (CFF) appears on cooling, which phase is usually associated with undesireable high tailings loss of copper in slag cleaning. Slags containing an amount of FeO greater than 32% (by weight) have a greater tolerance for lower lime in the $CaO$-$FeO$-$Fe_2O_3$ system while maintaining a melting point below 1300° C. However such slags are difficult to obtain given the normal oxidizing environment of an autogenous smelting furnace.

As an advantageous optional procedure in the process of the present invention, slag cleaning is an operation which directly produces and separates metallic copper from the slag. It is thus distinguished from the magnetic separation operation of Canadian application No. 424,742 discussed hereinbefore in which the slag is slow cooled, ground and subjected to magnetic separation to provide a nickel-iron-rich ferromagnetic material and non-ferro-magnetic copper-lime-rich material. Essentially no metallic copper is produced in the magnetic separation operation. In contrast, the slag-cleaning operation comprises the slag self-reduction step as discussed hereinbefore or a slag reduction operation using reductants such as coke, iron in finely divided form, aluminum metal, pyrites etc. followed by flotation of the slag in pulverized form. Flotation using normal xanthate collectors, produces a tails containing an average of about 0.7% by weight copper and a flotation product containing as high as 65% copper metal.

Coolant used in the process of the present invention can be any inert or oxidic copper-containing material. Advantageously metallic copper produced by cleaning slag is at least part of the coolant. Another coolant and/or recycle material is sludge produced from fines collected from the autogenous smelting off-gas. Part of these fines comprise dry dust separated from the off gas by cyclones and like devices. The other part of fines comprises sludge which contains partially oxidized sulfide feed material, gypsum (calcium sulfate) and copper hydroxide. Sludge is produced by collection by wet Cottrell precipitation and is dried prior to use in the autogenous smelter. A most advantageous coolant used in the process of the present invention is the product of roasting or partially roasting copper concentrate (essentially chalcopyrite concentrate). This roasting can be carried out on cencentrate alone or in the presence of limestone at a temperature of about 850° C. to 1000° C. The fully roasted product, when concentrate is roasted alone, comprises a copper ferrite. When cencentrate is roasted with lime or limestone the product essentially comprises a mixture of calcium sulfate and copper ferrite with the partially roasted product containing these materials and some heat modified sulfide concentrate. In addition to these copper-containing coolants, inert materials such as water, recirculated sulfur dioxide, cooled slag etc., are also to be used as coolant.

PARTICULAR DESCRIPTION OF THE INVENTION

A most advantageous aspect of the present invention is more particularly described in conjunction with the drawing. Referring now thereto a chalcopyrite concentrate containing about 28% to 30% copper is divided into two portions. The first portion designated X% concentrate 11 is roasted in fluid bed roaster 13 at 850°

C. to 1000° C. either by itself to form an oxidic calcine 14 comprising mainly $CuFe_2O_4$ and an $SO_2$-containing off-gas 17 or in the presence of limestone 15 to form a calcine 14 containing $CuFe_2O_4$, $CaSO_4$ and CaO and carbon dioxide off-gas 17.

The other portion of the chalcopyrite concentrate designated (100−X)% concentrate 19 is introduced along with slag concentrate 21 and sludge 23 into fluid bed drier 25. The product 27 of fluid bed drier 25 is fed along with calcine 14 and lime or limestone 31 into flash furnace 29 along with combustion oxygen 30. For flash furnace 29, (100−X)% concentrate 19, calcine 14, slag concentrate 21, sludge 23 and limestone or lime 31 are preferably correlated in amounts such that the operation of flash furnace 29 is autogenous without excess heat which would superheat slag, metal and furnace components. If the operation of flash furnace 29 cannot be maintained practically autogenous, means can be provided, as are well known to those of normal skill in the art, for supplying fuel for additional heat or auxiliary coolant for dissipating heat. For purposes of this invention it is advantageous to avoid or minimize the use of lime or limestone 15 in fluid bed roaster 13 and provide all or essentially all slag-forming lime as a direct addition of limestone or lime to flash furnace 29.

Flash furnace 29 has three principal products, copper metal 33, slag 35 and off-gas 37. Copper metal 33 is advantageously maintained at a semi-blister grade, this grade being defined as copper metal along with a small, visually observable amount of white metal ($Cu_2S$). The copper metal product 33 is subsequently subjected to a conventional converting or finishing operation 39 to produce anode copper 41 suitable for electrorefining. Off-gas 37 contains of sulfur dioxide and carbon dioxide (from limestone addition) and and carries with it dust 43. Some of dust 43 is recovered from cyclones or similar collectors. The bulk of the remaining dust 43 is precipitated electrostatically and forms sludge 23 with water. As disclosed hereinbefore sludge 23 is a feed material to fluid bed drier 25. If desired, sludge 23 can be treated to remove undesirable components e.g., bismuth, prior to being recycled through fluid bed drier 25. This mix of off-gases from flash furnace 29 is adaptable for use in sulfuric acid production as a means of producing a useful product and avoiding atmospheric contamination.

Molten slag 35 as a product of flash furnace 29 upon cooling will self-reduce (with respect to copper) provided the ferric to ferrous ratio of slag 35 is not too high. This self-reduction of copper employs the reaction:

$$Cu_2O+3FeO \rightarrow 2Cu+Fe_3O_4$$

ferric to ferrous molar ratio of slag 35 is in excess of about 3, it is likely that the copper content of slag 35 will be high e.g., above about 12% and that a goodly portion of this copper content will be, and remain on cooling as, oxidic copper. On the other hand, if the ferric to ferrous molar ratio of slag 35 is about 2 the copper content of slag 35 will likely be below 10% and, on cooling, the bulk of this copper content e.g., 90% will be in elemental form. As depicted in the drawing, slag 35 can be subjected to reduction operation 45 if the $Fe^{3+}/Fe^{2+}$ is too high. This reduction operation can be a conventional slag fuming operation involving any available carbonaceous gas, liquid or solid reductant with air injection to provide partial combustion of the reductant. The product of slag fuming is crude copper metal 47, some iron and essentially copper-free slag. The crude copper metal is recycled to flash furnace 29. More advantageously, reduction operation 45 can comprise contacting slag 35 with a finely divided coke or metal reductant during the cooling of slag 35. The reductant reacts very rapidly so that, under normal cooling conditions cooled slag 35 produces a solid in which copper is present primarily in metallic form. As an alternative to finely divided coke or metal reductant a sulfidic reductant can be used resulting in formation of metallic and sulfidic copper in cooled slag 35. When slag 35 is cool and in fragmented condition suitable for flotation, it is floated by conventional technology in flotation unit 49 to provide slag concentrate 21 and tailings 51. Slag concentrate 21 consisting principally of copper metal with or without copper sulfide is then reverted through fluid bed drier 25 to flash furnace 29.

In the drawing between slag 35 and flotation unit 49 an operation "fragmentation" 53 has been indicated. As in conventional technology fragmentation 53 can include the usual steps of crushing and grinding to provide a flotation feed. However, provided that slag 35 is properly constituted, it has been found the mere act of cooling slag 35 will cause decrepitation to a state which minimizes or eliminates conventional milling operations.

In order to give those skilled in the art a greater appreciation of the advantage of the invention the following Examples are given.

EXAMPLE I

Chalcopyrite concentrate was flash smelted to semi-blister copper in a pilot plant sized flash furnace along with flour coke (for heat make-up to approximate fully autogenous operation of a plant scale furnace) using the following conditions:

| | | |
|---|---|---|
| Feed Rate, Copper Conc. | kg/h | 2000 |
| Calcine | kg/h | 500 |
| Flash Furnace Sludge | kg/h | 200 |
| Limestone | kg/h | 550 |
| Oxygen* | s cmm | 8.5 |
| Temperature, | | |
| Bath Slag | °C. | 1500 |
| Bath Metal | °C. | 1390 |
| Flame | °C. | 1650 |
| Flash Smelting Time | h | 2.8 |
| kg Calcine/kg Copper Conc. | | 0.25 |
| kg Oxygen/kg Copper Conc. | | 0.35 |
| kg Sludge/kg Copper Conc. | | 0.10 |

*Not including oxygen for flour coke addition.

In this Example calcine, essentially copper ferrite, and flash furnace sludge act as coolants as well as sources of copper. Essentially all the calcareous material producing calcareous slag entered the flash furnace directly as limestone. The furnacing resulted in a white metal-saturated semi-blister copper and a slag having the following compositions in weight percent.

| | Cu | Ni | Fe | S | $SiO_2$ | CaO | $Fe_3O_4$ |
|---|---|---|---|---|---|---|---|
| Semi-blister | 95 | N/A | 0.01 | 0.01 | 1.4 | 0.02 | — |
| Slag | 9.6 | 1.0 | 33 | 0.6 | 3.1 | 17.0 | 41 |

EXAMPLE II

Flash smelting of chalcopyrite concentrate was carried out in the same equipment as used in Example I under the following conditions:

| | | |
|---|---|---|
| Feed Rate, Copper Conc. | kg/h | 2000 |
| Calcine | kg/h | 800 |
| Limestone | kg/h | 640 |
| Oxygen* | scmm | 8.5 |
| Temperature, | | |
| Bath Slag | °C. | 1420 |
| Bath Metal | °C. | 1350 |
| Flame | °C. | 1610 |
| Flash Smelting Time | h | 3 |
| kg Calcine/kg Copper Conc. | | 0.40 |
| kg Oxygen/kg Copper Conc. | | 0.35 |

*Not including oxygen for flour coke addition.

Product assays expressed in weight percent were as follows:

| | Cu | Ni | Fe | S | $SiO_2$ | CaO | $Fe_2O_4$ |
|---|---|---|---|---|---|---|---|
| Semi-blister | 96 | 1.8 | 0.1 | 0.5 | 0.1 | 0.04 | — |
| Slag | 8.2 | 0.9 | 44 | 0.3 | 3.6 | 19.9 | 42 |

EXAMPLE III

From another flash furnace heat carried out in a manner similar to Examples I and II four batches of slag were recovered analyzing in weight percent as follows:

| Slag | % Cu | % Ni | % Fe | % Si | % CaO | % $SiO_2$ | % MgO | % $M_2O_{30}$ |
|---|---|---|---|---|---|---|---|---|
| A | 5.64 | 0.71 | 43.7 | 0.46 | 19.8 | 6.7 | 4.8 | 1.3 |
| B | 5.17 | 0.73 | 43.4 | 0.34 | 20.7 | 6.1 | 5.0 | 1.1 |
| C | 5.21 | 0.69 | 42.8 | 0.90 | 22.0 | 6.3 | 4.3 | 1.1 |
| D | 5.60 | 0.97 | 41.9 | 0.29 | 20.3 | 5.7 | 6.5 | 1.1 |

Slags A, B, C and D were cleaned by flotation technique as described hereinbefore with slags B and C being subject to pre-reduction with 5 kg and 10 kg of coke respectively. Flotation results were as follows:

| | −100 meshMetallics | | Flotation Concentrate | | Tails | |
|---|---|---|---|---|---|---|
| Slag | % Cu | % Cu Rec. | % Cu | % Cu Rec. | % Cu | % Cu Loss |
| A | 68.8 | 1.9 | 46.5 | 69.7 | 0.82 | 11.9 |
| B | 77.5 | 4.4 | 48.3 | 67.8 | 0.77 | 12.5 |
| C | 86.9 | 4.0 | 49.4 | 55.2 | 1.12 | 18.0 |
| D | 89.5 | 12.5 | 53.3 | 57.7 | 0.76 | 11.3 |

Both metallics and flotation concentrate are suitable feed after drying for use as coolant and/or copper source in the flash furnace. If required copper-barren tails could also be used as coolant in the flash furnace.

While the present invention has been described and illustrated with respect to specific embodiments, those of normal skill in the art will appreciate that modifications and variations are intended to come within the ambit of the appended claims.

The embodiments of the invention in which an exclusive property or privilege is claimed are defined as follows:

1. A process for the production of an iron-free, copper metallic copper product at least as rich in copper as semi-blister copper comprising charging a calcareous flux and an iron containing sulfidic ore concentrate from the group consisting of chalcopyrite concentrate and bornite concentrate having a high iron to silica ratio into a bounded space and autogenously combusting said sulfidic ore concentrate therein with an oxygen-containing gas in the presence of a coolant to thereby privide a slag based upon the components CaO, FeO and $Fe_2O_3$ containing essentially all the iron and silica of the charged materials, a molten copper metal and an off-gas containing sulfur dioxide.

2. A process as in claim 1 wherein said bounded space is a flash furnace.

3. A process as in claim 1 wherein said calcareous flux is a member selected from the group consisting of lime, slaked lime and limestone.

4. A process as in claim 1 wherein the iron present in said slag based upon the components $Fe_2O_3$-FeO-CaO has a $Fe^{3+}$ to $Fe^{2+}$ ratio no greater than about 2.5.

5. A process as in claim 1 wherein at least part of the coolant employed contains a copper oxide and is selected from the group consisting of natural oxidic copper ores and the roasted product of a sulfidic ore concentrate.

* * * * *